US006732433B2

(12) United States Patent
Sleger

(10) Patent No.: US 6,732,433 B2
(45) Date of Patent: May 11, 2004

(54) METHOD OF MANUFACTURING AN INKJET NOZZLE PLATE AND PRINTHEAD

(75) Inventor: Roger Robert Sleger, Eagle, ID (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 58 days.

(21) Appl. No.: 09/931,954

(22) Filed: Aug. 17, 2001

(65) Prior Publication Data

US 2003/0206217 A1 Nov. 6, 2003

Related U.S. Application Data

(62) Division of application No. 09/484,172, filed on Jan. 17, 2000, now Pat. No. 6,523,938.

(51) Int. Cl.[7] ..... B21D 53/76; B24B 1/00

(52) U.S. Cl. ..... 29/890.1; 29/417; 451/41

(58) Field of Search ..... 29/890.1, 611, 29/25.35, DIG. 16, 417, 412, DIG. 19; 347/63, 65, 64, 67, 44, 47; 451/41

(56) References Cited

U.S. PATENT DOCUMENTS

| | | | | |
|---|---|---|---|---|
| 3,930,260 A | | 12/1975 | Sicking | |
| 4,112,436 A | * | 9/1978 | Cone | 29/417 X |
| 4,528,577 A | | 7/1985 | Cloutier et al. | |
| 4,578,687 A | | 3/1986 | Cloutier et al. | |
| 4,616,408 A | | 10/1986 | Lloyd | |
| 4,677,447 A | | 6/1987 | Nielsen | |
| 4,943,816 A | | 7/1990 | Sporer | |
| 5,469,200 A | * | 11/1995 | Terai | 347/63 |
| 5,560,837 A | | 10/1996 | Trueba | |
| 5,706,039 A | | 1/1998 | Chamberlain et al. | |

FOREIGN PATENT DOCUMENTS

| | | | |
|---|---|---|---|
| JP | 55-128470 | * 10/1980 | 347/65 |

OTHER PUBLICATIONS

Chen et al, "A High–Resolution silicon Monolithic Nozzle Array for Inkjet Printing", Sep. 1997, IEEE Transactions on Electron Devices, vol. 44, No. 9, pp. 1401–1409.*

* cited by examiner

*Primary Examiner*—A. Dexter Tugbang

(57) ABSTRACT

Manufacturing an inkjet printhead and orifice plate by providing upstanding spaced apart barrier walls on the orifice plate to separate adjacent firing chambers on the printhead. A plurality of orifice plates are initially created in a one-layer array on a workpiece. An abrasive member is controlled to contact and truncate end edge portions of the barrier walls on the workpiece to create mutually coplanar surfaces for engagement with a substrate in order to help prevent cross-talk between adjacent firing chambers.

6 Claims, 6 Drawing Sheets

Figure 1:
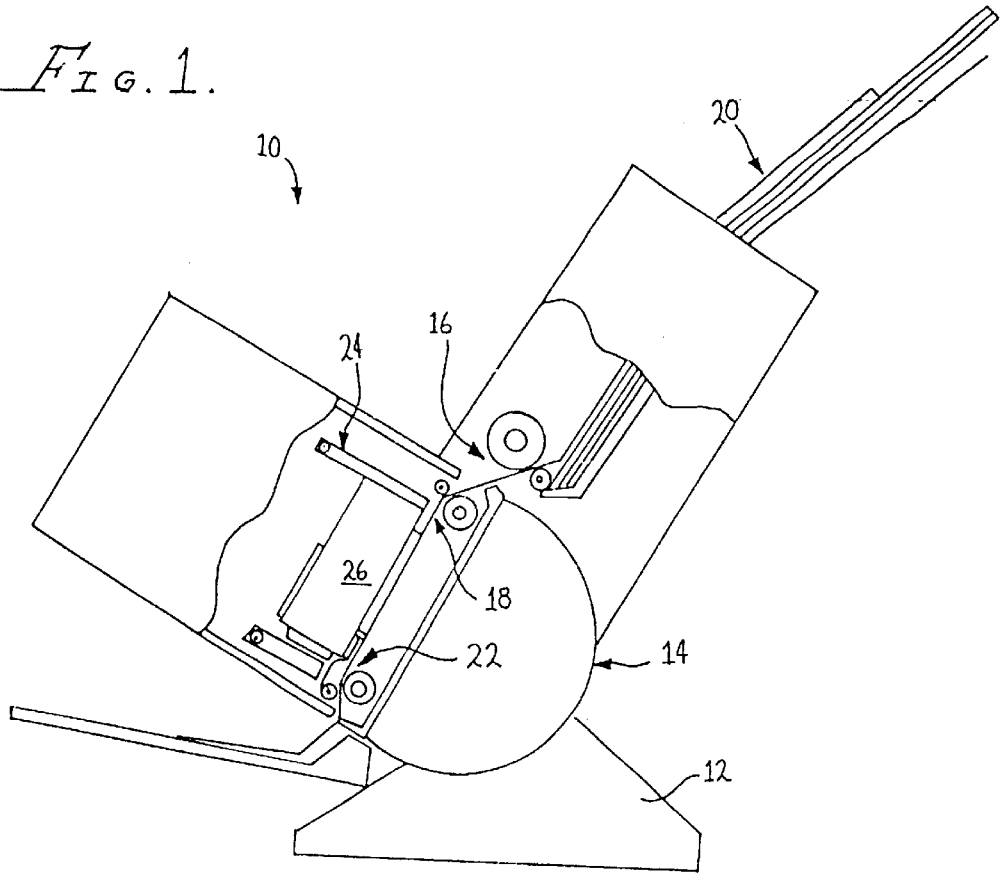

FIG. 9.a.
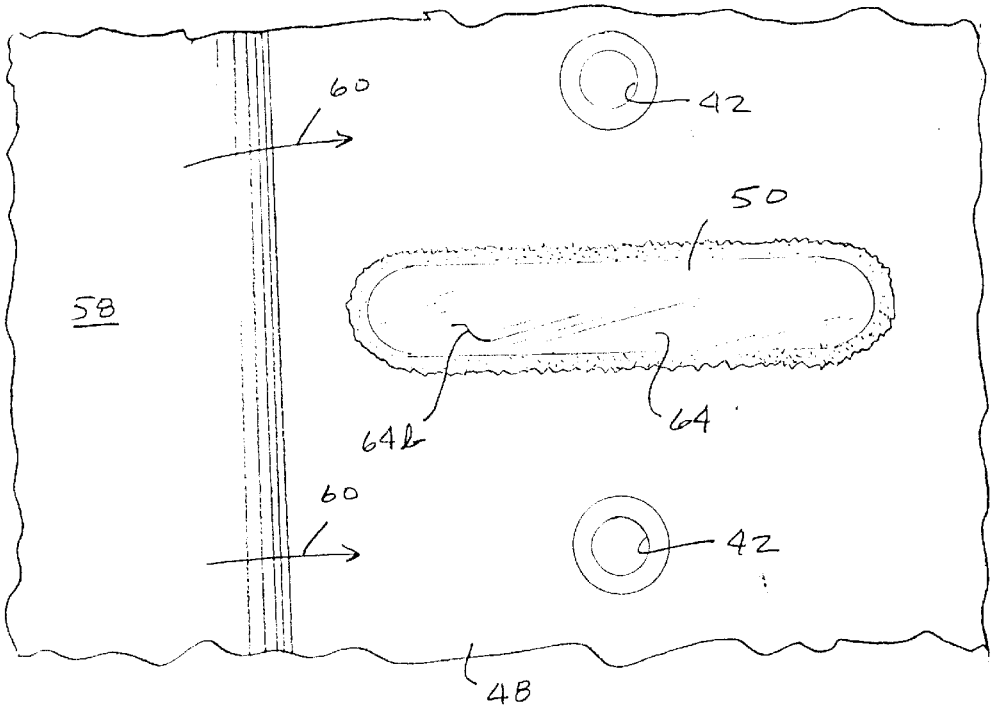
FIG. 6.a.
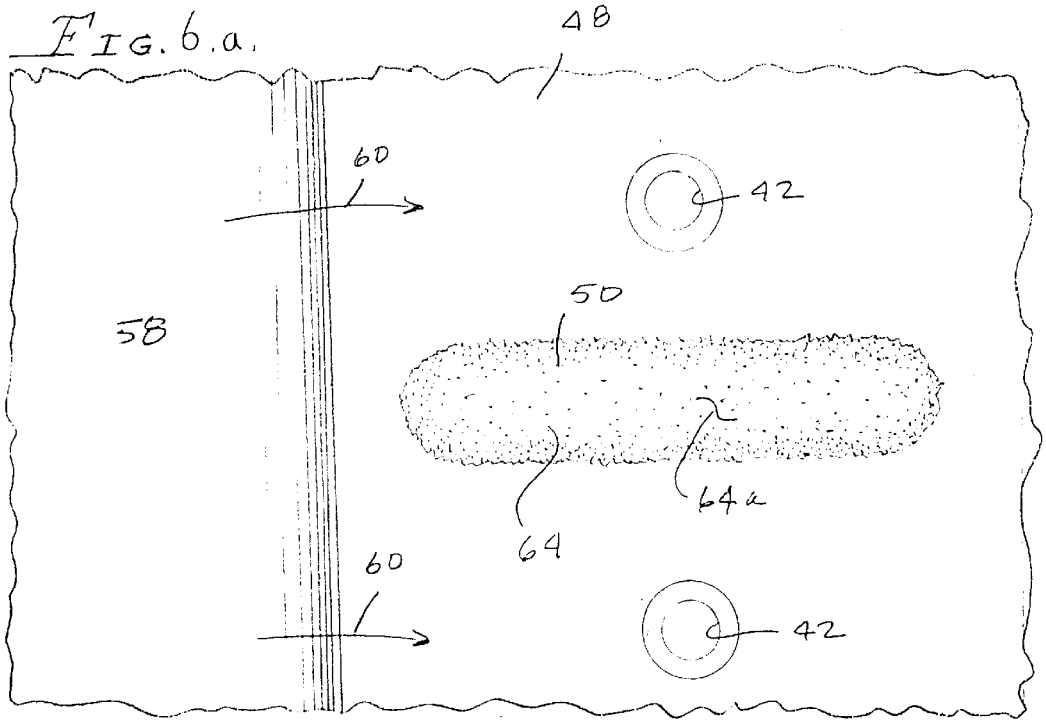

FIG. 6. b.
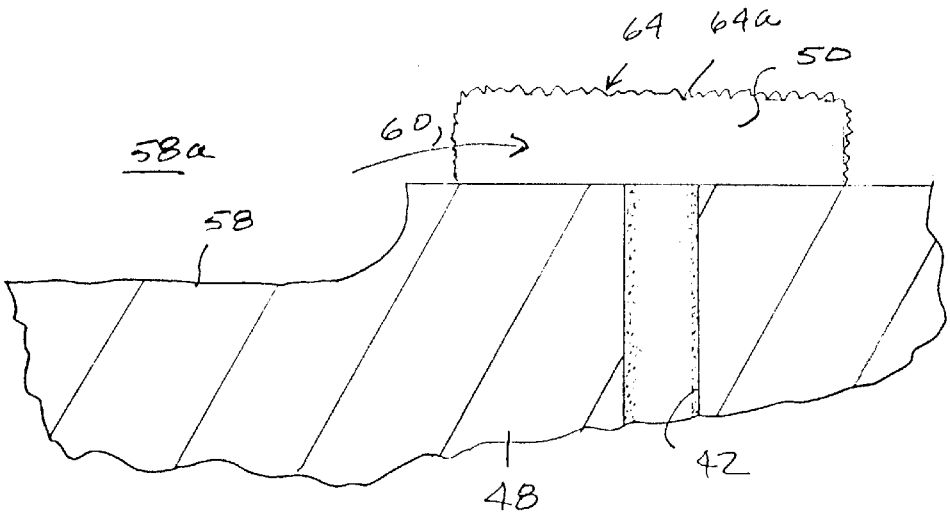
FIG. 9. b
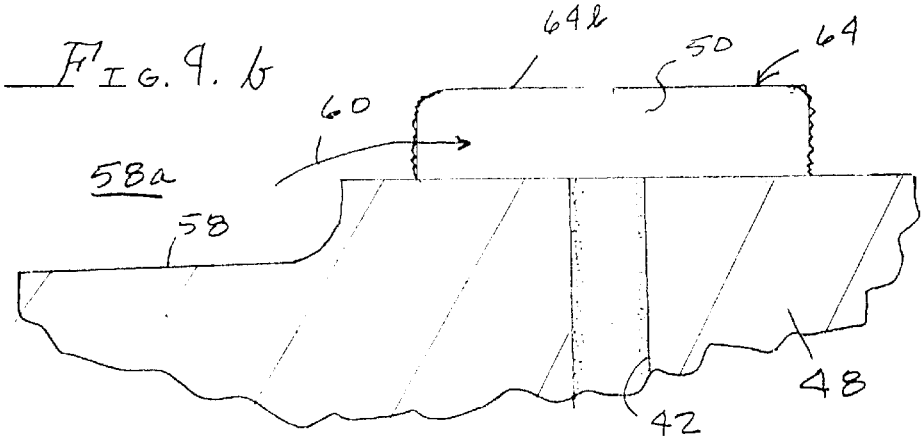
FIG. 9. C.
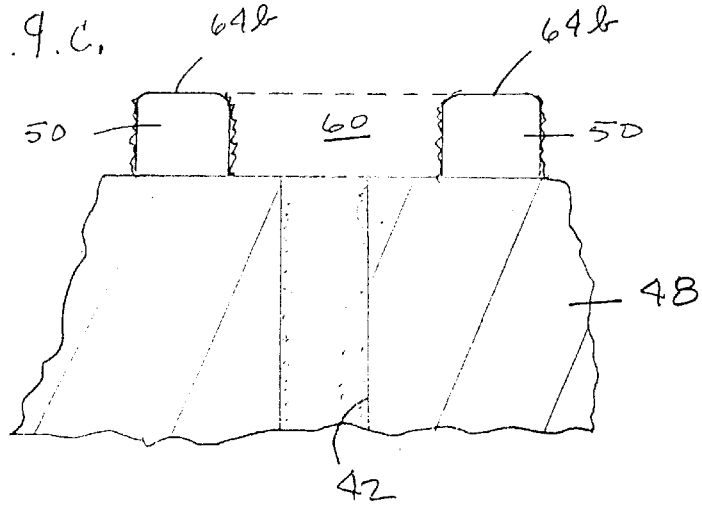

METHOD OF MANUFACTURING AN INKJET NOZZLE PLATE AND PRINTHEAD

CROSS REFERENCE TO RELATED APPLICATION

This is a divisional of application Ser. No. 09/484,172 filed on Jan. 17, 2000 now U.S. Pat. No. 6,523,938.

BACKGROUND OF THE INVENTION

1. Field of the Invention

This invention relates generally to inkjet printing. More particularly, this invention relates to an inkjet print cartridge which has improved reliability, and improved ease and reliability of manufacturing. That is, the inkjet cartridge provides a robust design with reduced variability and improved manufacturing. The present invention also relates to an inkjet printer having such an inkjet print cartridge, and to a method for manufacturing such an inkjet print cartridge.

2. Related Technology

Inkjet printers or plotters typically have a print cartridge mounted on a carriage. This carriage is traversed back and forth across the width of a print medium (i.e., usually paper or a plastic plotting film, for example) as the print medium is fed through the printer or plotter. Plural orifices on the print cartridge are fed ink (or other printing fluid) by one or more channels communicating from a reservoir of the print cartridge. Energy applied individually to addressable resistors (or other energy-dissipating elements, for example, to piezoelectric actuators), transfers energy to printing fluid which is within or associated with selected ones of the plural orifices. This energy causes a portion of the printing fluid to momentarily convert to vapor phase and to form a vapor bubble. Thus, this type of printer is also sometimes referred to as a "bubble jet printer." As a result of the formation and expansion of the vapor bubble, some of the ink is ejected out of the respective orifice toward the print medium (i.e., forming an "ink jet"). As the ink is ejected, the bubble collapses almost simultaneously, allowing more ink from the reservoir to fill the channel. This quick ejection of an ink jet from a selected orifice, and almost simultaneous collapse of the bubble which caused this ejection, allows for the ink jet printing cycle to have a high repetition rate.

The challenges of manufacturing such inkjet print cartridges are many. Among these challenges is the manufacturing of a fine-dimension orifice plate that forms a part of a printhead of the print cartridge. This orifice plate not only defines the plural fine-dimension orifices from which ink jets issue to the print medium, it also forms a part of the ink feed channel(s) bringing ink to the orifices. The orifice plate also defines plural barrier walls, each one of which is positioned between a pair of adjacent orifices. The respective barrier walls between adjacent orifices substantially prevent an ink ejection event at one orifice from causing ink to be ejected from an adjacent orifice.

Conventional ink jet print cartridges or components for such cartridges are seen in U.S. Pat. Nos. 3,930,260; 4,578,687; 4,677,447; 4,943,816; 5,560,837, and 5,706,039. However, none of these conventional ink jet print cartridges are believed to include an orifice plate with plural barrier walls each of which intimately cooperates with a print head thin film structure carried upon a substrate of the print cartridge.

SUMMARY OF INVENTION

In view of the deficiencies of the related technology, an object for this invention is to reduce or overcome one or more of these deficiencies.

Accordingly, the present invention provides an inkjet printhead for ejecting printing fluid during a printing event, the printhead comprising a substrate; a thin-film structure carried on the substrate, the thin-film structure including an energy-dissipating element for providing energy for ejecting printing fluid from the printhead during a printing event; a fine-dimension orifice plate attached to the thin-film structure and defining an orifice from which printing fluid is ejected during a printing event; the fine-dimension orifice plate including a pair of barrier walls spaced apart one on each side of the orifice, the barrier walls each defining a respective one of a pair of end edges, and the pair of end edges being coplanar with one another, whereby the pair of barrier walls at the pair of coplanar end edges each engage the thin-film structure.

According to another aspect, this invention provides a fluid printing cartridge for ejecting printing fluid onto a printing medium, the printing cartridge comprising: a cartridge body defining a printing fluid chamber, and a printing fluid delivery assembly; a printhead having a substrate and receiving printing fluid from the printing fluid chamber via the printing fluid delivery assembly to controllably eject this printing fluid onto the printing medium, the printhead including: a thin-film structure carried on the substrate and including an energy dissipating element for providing energy to the printing fluid to eject the printing fluid from the printhead, a fine-dimension orifice plate attached to the thin-film structure and defining an orifice from which printing fluid is ejected, the fine-dimension orifice plate including a pair of barrier walls spaced apart one on each side of the orifice, the pair of barrier walls each defining a respective one of a pair of end edges, and the pair of end edges being coplanar with one another so that the pair of barrier walls at the pair of end edges each engage the thin-film structure.

Still another aspect of the present invention provides a method of making a fluid jet print head, the method comprising steps of: providing a substrate; forming a thin-film structure on the substrate; including in the thin-film structure an energy-dissipating element for providing energy to eject printing fluid from the printhead; providing a fine-dimension orifice plate, forming in the fine-dimension orifice plate an orifice from which printing fluid is ejected, and a pair of barrier walls spaced apart one on each side of the orifice; utilizing the pair of barrier walls to each define a respective one of a pair of end edges, and forming the pair of end edges to each be coplanar with one another, whereby the pair of barrier walls at the pair of end edges each engage the thin-film structure.

Other objects, features, and advantages of the present invention will be apparent to those skilled in the pertinent arts from a consideration of the following detailed description of a single preferred exemplary embodiment of the invention, when taken in conjunction with the appended drawing figures, which will first be described briefly.

BRIEF DESCRIPTION OF THE DRAWING FIGURES

Figure 2:
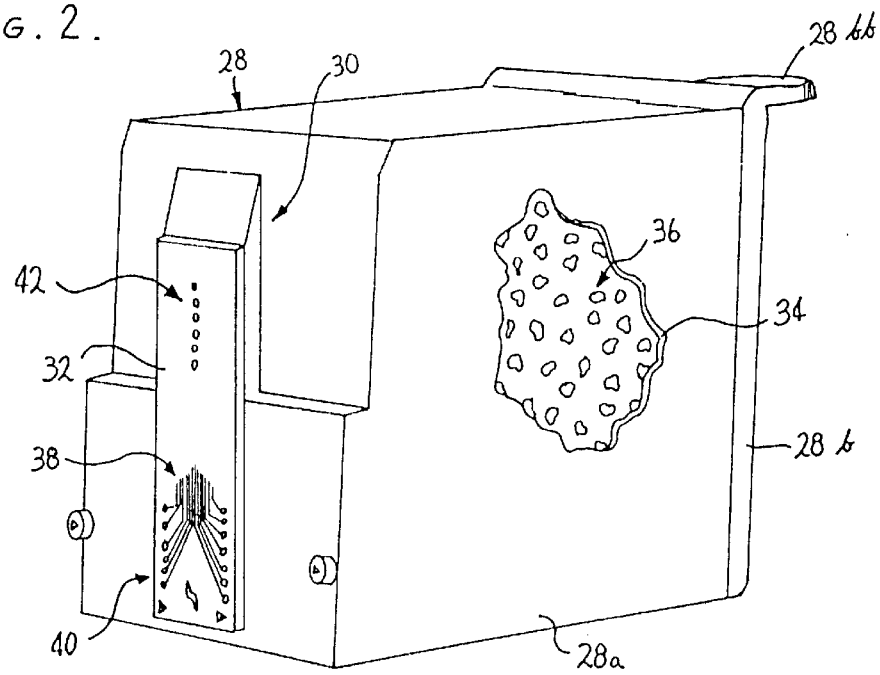
Figure 3:
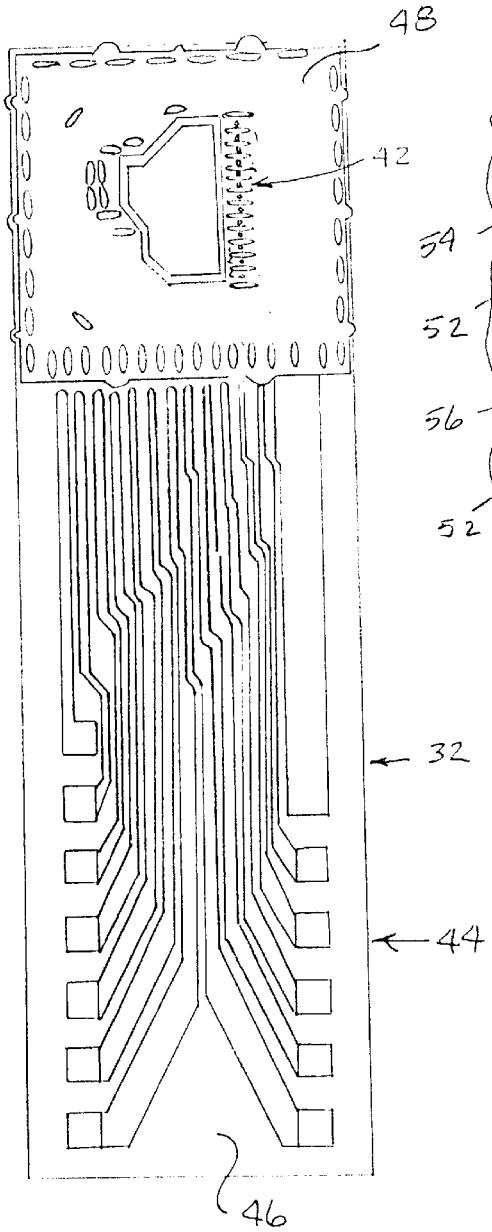
Figure 4:
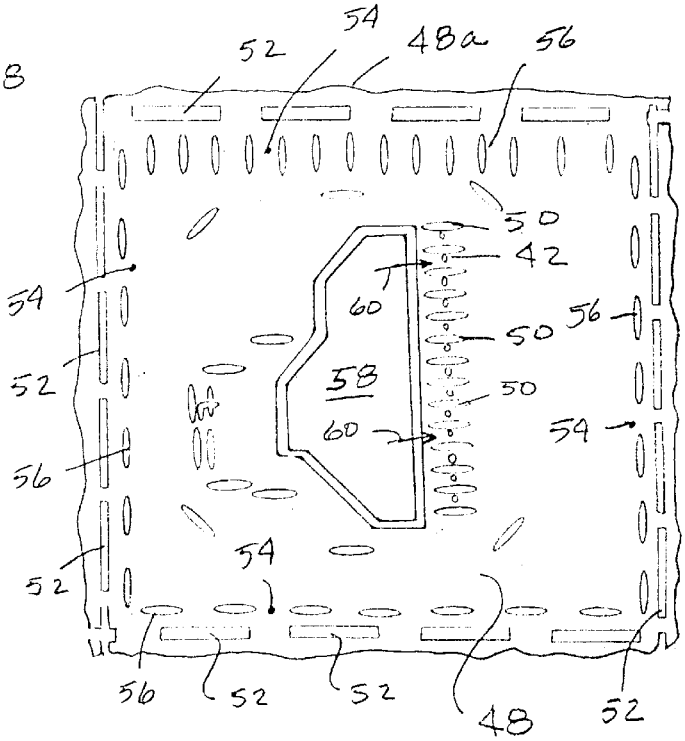
Figure 5:
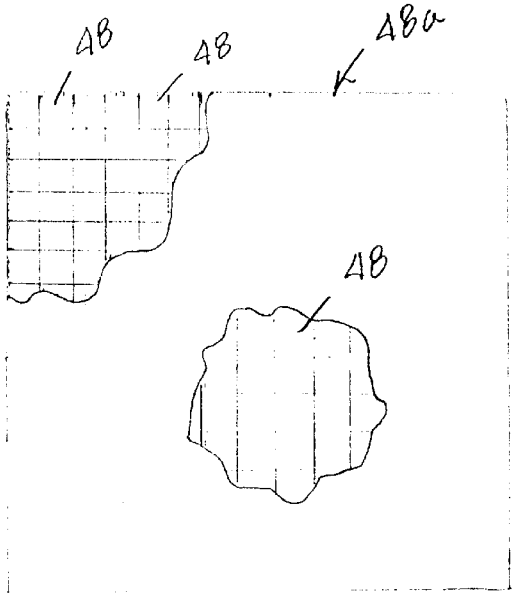

FIG. 1 is a diagrammatic side elevation view of an inkjet printer which uses an exemplary inkjet print cartridge embodying the present invention;

FIG. 2 provides a perspective view of an exemplary inkjet print cartridge, which may be used in the printer of FIG. 1, and with a portion of the inkjet print cartridge broken away for clarity of illustration;

FIG. 3 provides a plan-view of a printhead portion of the inkjet print cartridge seen in FIG. 2;

FIG. 4 provides a greatly enlarged plan view of a component part of the print head seen in FIG. 3, but shows the opposite side of this component;

FIG. 5 shows a manufacturing intermediate article which provides plural (256 in this case) component parts like that part seen in FIG. 4, and while these plural component parts are all integral with one another in the manufacturing intermediate article;

FIG. 6*a* provides a drawn illustration of a portion of the component part seen in FIG. 4 at a first stage of manufacture, but is drawn in a still larger size than FIG. 4 in order to provide clarity of illustration;

FIG. 6*b* is a fragmentary elevation view, partly in cross section, of a portion of the component part seen in FIG. 6*a;*

Figure 9D:
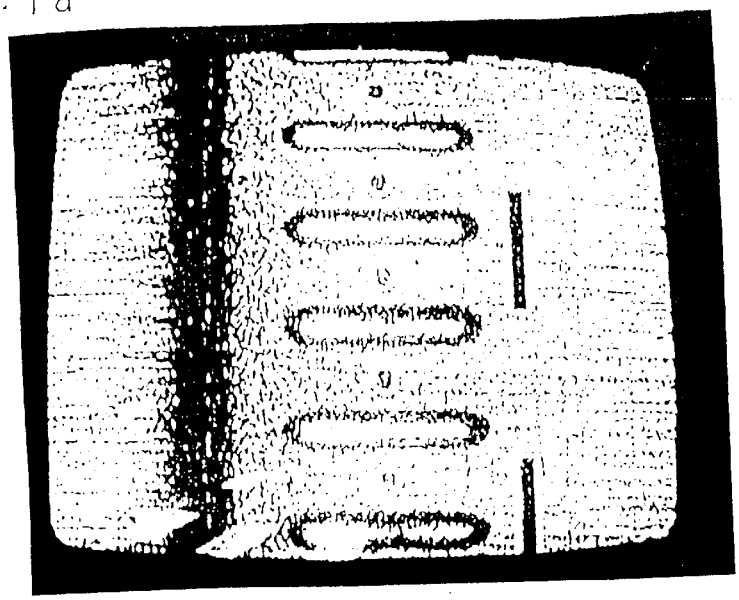
Figure 6C:
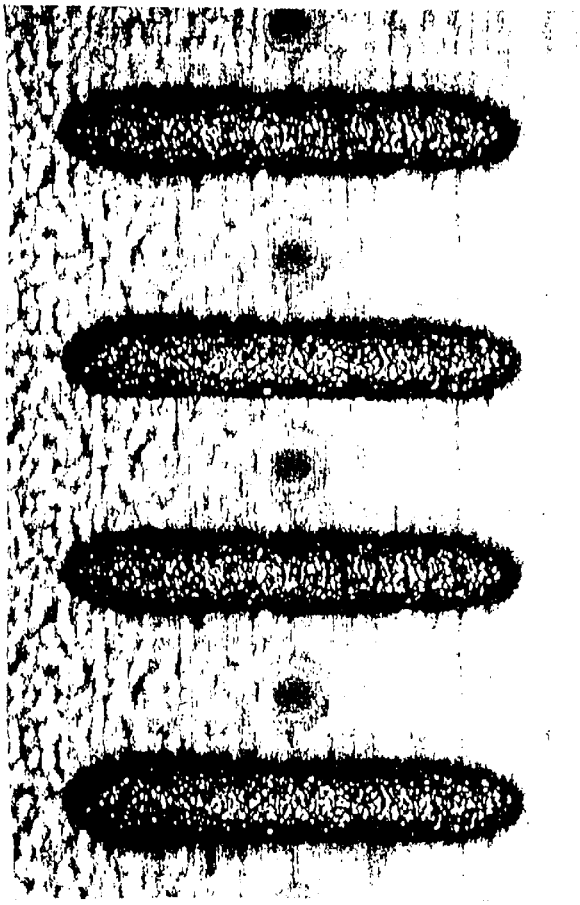
Figure 7:
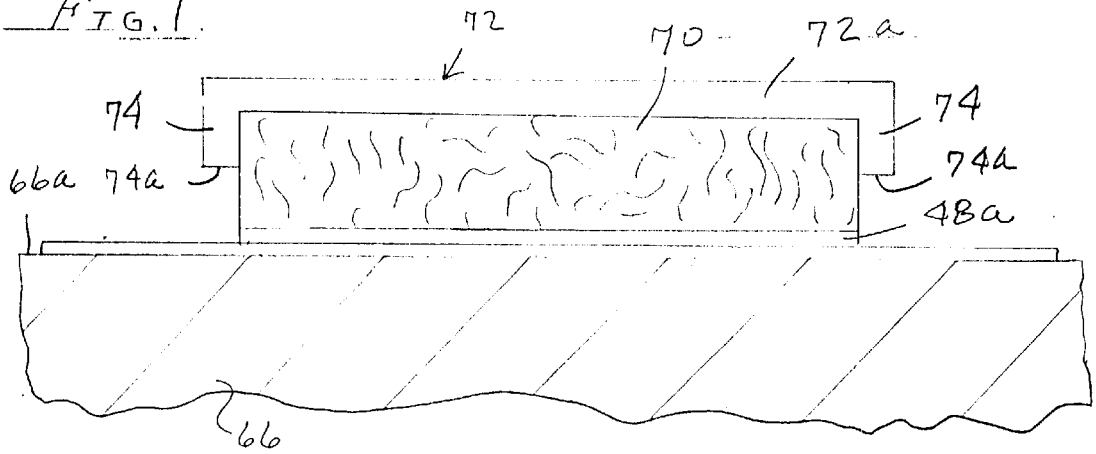
Figure 8:
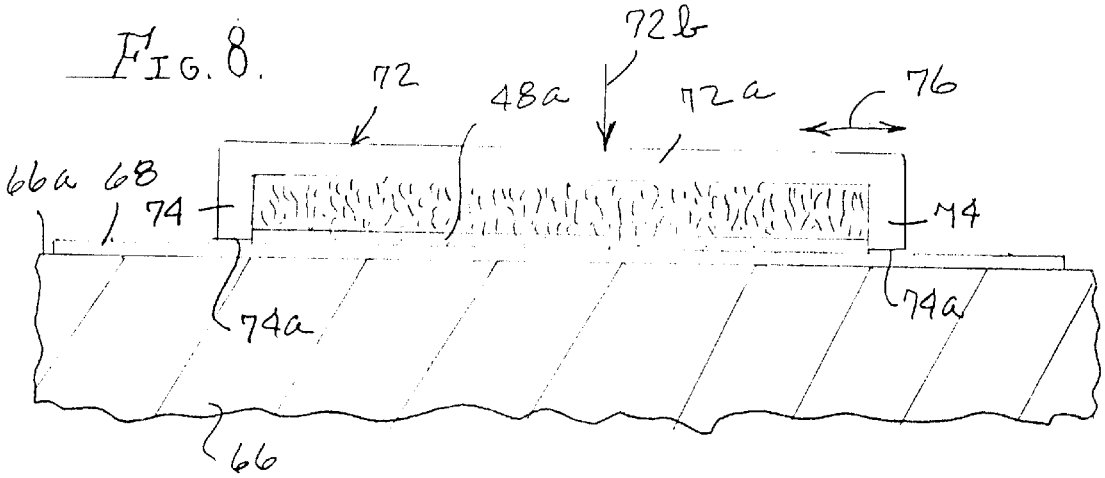

FIG. 6*c* is a microphotograph from which FIG. 6*a* was drawn, and showing the same portion of a component part seen in FIG. 4, and at the same stage of manufacture;

FIGS. 7 and 8 show subsequent steps in the method of manufacturing a component part as is seen in FIG. 4;

FIG. 9*a* is a drawn illustration of the component part seen in FIG. 6*a*, but showing the component subsequent to the manufacturing steps seen in FIGS. 7 and 8;

FIG. 9*b* is similar to FIG. 6*b*, but shows the component part subsequent to the manufacturing steps of FIGS. 7 and 8;

FIG. 9*c* provides an elevation view similar to that of FIG. 9*b*, but is taken orthogonally to the direction of view of FIG. 9*b*; and FIG. 9*d* is a microphotograph similar to that of FIG. 6*c*, and is the photograph from which FIG. 9*a* is drawn, but shows the component part subsequent to the manufacturing steps of FIGS. 7 and 8.

DETAILED DESCRIPTION OF A PREFERRED EXEMPLARY EMBODIMENT OF THE INVENTION

FIG. 1 shows an exemplary inkjet printer 10. This printer 10 includes a base 12 carrying a housing 14. Within the housing 14 is a feed mechanism 16 for controllably moving a print medium (i.e., paper this case, although the invention is not so limited) through the printer 10. Those ordinarily skilled in the pertinent arts will understand that the feed mechanism 16 may be configured to feed sheet paper or medium, or may be configured to feed roll paper or medium, or may be configured to feed print medium of another shape or style. In this exemplary printer 10, the feed mechanism 16 controllably moves a single sheet of paper 18 from a paper magazine 20 along a print path 22 within the printer 10. The printer 10 includes a traverse mechanism 24 (i.e., a carriage) carrying an inkjet print cartridge 26. The traverse mechanism moves the inkjet printing cartridge 26 perpendicularly to the direction of movement of the paper 18 (i.e., the cartridge 26 is moved perpendicularly to the plane of FIG. 1). The printer 10 uses the inkjet printing cartridge 26 to controllably place small droplets of printing fluid (i.e., ink, for example) from the inkjet printing cartridge 26 on the paper 18. By moving the inkjet printing cartridge 26 repeatedly back and forth across the paper 18 as this paper is advanced by the feed mechanism 16 characters or images may be controllably formed by ejection and placement on the paper 18 of many small droplets of ink from the cartridge 26. These small droplets of ink are ejected in the form of ink jets impinging on the paper 18 in controlled locations to form the desired characters and images, as will be well known to those ordinarily skilled in the pertinent arts.

FIG. 2 illustrates the exemplary inkjet printing cartridge 26. This inkjet printing cartridge 26 includes a cartridge body 28. The cartridge body includes a molded, generally rectangular, and cup-like body portion 28*a*; and a molded complimentary closure or lid portion 28*b*. From the lid portion 28*b* extends a tab 28*bb*, which provides for manual purchase on the print cartridge 28. That is, the user of a print cartridge 28 may grasp the tab 28*bb* in order to, for example, insert the print cartridge into the carriage 24 of the printer 10 or to remove the print cartridge from this carriage. The body portion 28*a* defines a fluid delivery assembly (generally referenced with the numeral 30) supplying printing fluid (such as ink) to a printhead 32 externally carried on this body portion 28*a*. The fluid delivery assembly 30 may include an open-cell, fine-grained sponge 34 carried within a chamber 36 of the body 28, and a standpipe (not shown), conveying the printing fluid from the chamber 36 to the printhead 32. The body portions 28*a* and 28*b* cooperatively define and bound the chamber 36 to receive the sponge 34 along with a supply of printing fluid (i.e., ink) within this chamber to the printhead 32.

Those ordinarily skilled in the pertinent arts will understand that the printhead 32 includes a printing circuit 38 which electrically couples the printhead 32 with the printer 10 via circuit traces 38*a* and plural electrical contacts 40. That is, the electrical contacts 40 individually make electrical contact with matching contacts (not seen in the drawing Figures) on the traverse mechanism 24, and provide for electrical interface of the printhead 32 with electrical driving circuitry (also not illustrated in the drawing Figures) of the printer 10. Individual ones of plural fine-dimension orifices 42 of the printhead 32 eject printing fluid when appropriate control signals are applied to selected ones of the plural contacts 40. In other words, the fine-dimension orifices 42 controllably eject fine-dimension droplets of printing fluid onto the print medium 18 in order to form characters and images on this print medium.

The structure of the printhead 32 is shown in greater detail in FIG. 3. This printhead 32 includes a substrate 44 which may be formed as a plate of glass (i.e., an amorphous, generally non-conductive material). In this exemplary preferred embodiment, the substrate 44 is generally rectangular in plan view, although the invention is not so limited. Most preferably, this glass substrate is an inexpensive type of soda/lime glass (i.e., like ordinary window glass), which makes the printhead 32 very economical to manufacture, The printhead 32 is especially economical and inexpensive to manufacture when considered in comparison to printheads using the conventional technologies requiring a substrate of silicon or other crystalline semiconductor materials.

On the glass substrate 44 is formed a thin-film structure 46 of plural layers. During manufacturing of the printhead 32 this thin-film structure 46 is formed substantially of plural thin-film layers applied one after the other, with each one formed atop of the earlier layers, and with each thin-film layer entirely covering and being congruent with the plan-view shape of the substrate 44. Once selected ones of these thin-film layers are formed on the substrate 44, subsequent patterning and etching operations are used to define the contacts 40 and print circuit 38, for example. An example of a thin-film structure that may be used to form a printhead 32 includes a first metallic multi-function heat sink and radio frequency shield and ion barrier layer, which is applied upon the glass substrate 44. This first layer may preferably be formed of chrome about 1 to 2 microns thick. Alternatively, the layer first layer may be formed of other metals and alloys. For example, the first thin-film heat sink and RF shield and ion barrier layer may be formed of aluminum, chrome, copper, gold, iron, molybdenum, nickel, palladium, platinum, tantalum, titanium, tungsten, a refractory metal, or of alloys of these or other metals.

Upon the first metallic thin-film layer may be formed an insulator thin-film layer. The insulator thin-film layer is preferably formed of silicon oxide, and is about 1 to 2 microns thick. Next, on the substrate 44 and upon the insulator layer may be formed a resistor thin-film layer. The thin-film resistor layer is preferably formed of tantalum aluminum alloy, and is preferably about 600 Angstroms thick. Next, over the resistor layer may be formed a metallic conductor thin-film layer. This metallic conductor thin-film layer is formed preferably of an aluminum based alloy, and is about 0.5 micron thick. This conductor layer is later patterned and etched back to cover only the area defining the traces 38*a* of print circuit 38, and also the area defining the contacts 40. This conductive layer is patterned and etched away at selected fine-dimension areas aligning individually with the fine-dimension orifices 42 in order to form fine-dimension resistors (not shown in the drawing Figures).

Over a portion of the traces 38 and over the individual resistors formed in the tantalum aluminum alloy resistive layer, an orifice plate 48 is adhesively secured to the thin-film structure 46 upon the substrate 44. This orifice plate 48 defines the fine-dimension orifices 42, defines a chamber (to be further described below) receiving ink from the reservoir 36, and also defines plural spaced apart barrier walls 50. The barrier walls 50 are interposed between each adjacent pair of the orifices 42 in the plate 48, and extend from the plate 48 to the thin-film structure 46 on the substrate 44.

Viewing now FIG. 4, an orifice plate 48 is illustrated greatly enlarged from its actual size. In reality, this orifice plate 48 is about one-quarter inch square, and is manufactured as a part of a sheet-like work piece (indicated with the numeral 48*a*) containing many of these orifice plates. For example, in FIG. 5 is illustrated an exemplary manufacturing intermediate article, which is the work piece 48*a*, and which in this particular case includes a 16×16 array of the orifice plates 48 (i.e., 256 orifice plates) each integrally connected to its neighboring orifice plates to form the work piece 48*a*. Viewing FIG. 4 in greater detail, it is seen that the work piece 48*a* defines plural elongate perforations 52, which are aligned with one another in rows and columns to define separation lines. As a result, the individual orifice plates 48 can be separated from the work pieces 48*a* along these separation lines. As FIG. 4 also illustrates, the individual orifice plates 48 each define a generally rectangular or square shape, of which a peripheral portion 54 is defined by plural cooperative upstanding ribs 56. These ribs 56 allow the orifice plates 48 to be adhesively attached individually to the thin-film structure 46 of a printhead 32. That is, the ribs 56 provide purchase for an adhesive to grip the orifice plate 48. Each orifice plate 48 also defines a recess 58, which is somewhat "piano" shaped, and which aligns with an ink feed hole (not illustrated in the drawing Figures) formed through the substrate 44 and through the thin-layer structure 46 in order to feed ink from chamber 36 to the fine-dimension orifices 44. The recess 58 in cooperation with the adjacent fine-dimension structure 46 of the printhead 32 forms a fine-dimension capillary chamber (indicated with arrowed numeral 58*a*) for receiving this ink, as was mentioned earlier. This recess 58 (and chamber 58*a*) communicate with the orifices 42, by way of plural channels 60, each of which is defined between a pair of adjacent barrier walls 50. The barrier walls 50 are integral with the orifice plate 48, and extend toward and to the thin-film structure 46 on the substrate 44, so that an end edge 64 of each of the barrier walls rests upon the thin-film structure.

FIGS. 6*a*, 6*b*, and 6*d* each illustrate the barrier walls 50 on plate member 48 at a stage of manufacture represented by FIG. 4. That is, the barrier walls 50 at this stage of manufacture are rough, and define an end edge 64 with an end edge surface 64*a* which is similarly rough. Importantly, the end edge surfaces 64*a* of the plural barrier walls 50 are not necessarily planar with one another. If the orifice plate 48 were employed in this condition to make a printhead 32, then not all of the barrier walls 50 would necessarily engage with the thin-film structure 46 on the substrate 44. That is, the higher (i.e., longer) barrier walls 50 would likely engage the thin-film structure. But, the lower (i.e., shorter) barrier walls 50 may not engage well with the thin-film structure, and would allow gaps to exist between the end edge surfaces 64*a* of the barrier walls and the thin-film structure. These gaps could provide sufficient communication between the channels 60 that when an ink jet printing event is conducted at one of the channels, at least one of the adjacent ink channels would have ink ejected also from its orifice 42. This ejection of ink from an orifice as a result of an ink jet printing operation at an adjacent orifice is called "cross talk," and decreases the desirable operating characteristics of a print cartridge. In some cases, cross talk will be so bad that a cartridge is not usable.

However, FIGS. 7 and 8 illustrate steps in a method of both smoothing and mutually planarizing the barrier walls 50, so that a new end edge surface (to be referenced with numeral 64*b*) is formed on these barrier walls. Viewing now FIG. 7, it is seen that the work piece 48*a* is disposed upon a surface plate member 66 having an upper flat surface 66*a*. Interposed between the work piece member 48*a* and the surface 66*a* is a sheet 68 of fine abrasive material (i.e., abrasive cloth or paper, for example). The work piece member 48*a* is placed on the abrasive cloth or paper 68 with the side seen in FIG. 4 downwardly. That is, the barrier walls 50 are disposed toward the abrasive cloth or paper 68, and the end edges 64 (i.e., at surfaces 64*a*) of these barrier walls engage with the abrasive. On top of the work piece member 48*a* is placed an elastic conformal pad of comparatively soft, compliant, and resilient yieldably shape retaining material 70. The pad 70 has a plan view shape substantially the same as that of work piece 48*a*. Over the pad 70, a backing member 72 is placed. The backing member 72 has a central plate portion 72*a* of sufficient stiffness that pressure applied to this backing member (indicated by arrows 72*b*) urging it toward the surface plate 66 does not distort this backing member 72 significantly, and this backing member 72 evenly distributes the force 72*b* over the area of the backing member 72 and of work piece 48*a*. Thus, this force toward the surface plate 66 is applied to the pad 70 uniformly. As is seen in FIG. 8, the force 72*b* is sufficient to compress or distort the conformal member of the pad 70 over the entire area of the work piece 48*a*.

The backing member 72 also includes a peripheral depending lip portion 74, having an end edge 74*a*. The end edge 74*a* is uniformly dependent all about the perimeter of work piece 48*a* relative to the plate part 72*a* of the backing member 72. As a result, as is seen in FIG. 8, the force 72*b* compresses the conformal pad 70 so that the end edge 74*a* engages the surface plate 66 all about the perimeter of the backing member 72. This peripheral engagement of the depending lip 74 insures that parallelism of the plate portion 72*a* is maintained. Further, the conformal pad 70 insures that the force 72*b* is uniformly distributed over the area of the work piece 48*a*.

Actually, it is seen that the backing member at end edge surface 74*a* engages the abrasive material 68, although the method is not limited to this feature. That is, the plate portion 72*a* could be extended laterally sufficiently that the lip 74 and its end edge 74*a* contact the surface plate 66 and do not contact the abrasive material 68. Further, as is seen in FIG. 8, the backing member and work piece 48*a* are moved relative to the abrasive material 68 while parallelism is maintained (as is indicated by arrows 76). The yieldable shape retaining elasticity of the pad 70 controls the amount of force applied to the work piece 48*a*, and the pad 70 also insures that this force is applied uniformly while parallelism is maintained between plate 66 and plate portion 72*a*. Consequently, after a determined amount of time and motion 76 (or number of motion strokes, for example), the work piece 48*a* is removed from the apparatus seen in FIGS. 7 and 8.

FIGS. 9*a*–9*d* illustrate the result of the process steps indicated in FIGS. 7 and 8. The barrier walls 50 now have a smooth, polished, and planarized end edge surface 64*b*. Further, as is seen in FIG. 9*c*, these end edge surfaces 64*b* are also coplanar with one another. As a result, when the orifice plate 48 is installed on a substrate 44 (i.e., on a thin-film structure 46), the end edge surfaces 64*b* of the barrier walls 50 each make close and uniform contact with the thin-film structure 46. As a result, the occurrence of gaps between the barrier walls 50 and the thin-film structure 46, and cross talk between adjacent orifices 42 during an ink jet ejection from an orifice 42, are both substantially eliminated. Actual use of the present invention has demonstrated that ink jet print cartridges made according to and embodying this invention are substantially free of cross talk. On the other hand, ink jet cartridges made in all respects the same, except that they do not include planarizing of the barrier walls 50, have a significant occurrence of cross talk, and in some cases this condition is so severe that the print cartridge is not usable.

Those skilled in the art will further appreciate that the present invention may be embodied in other specific forms without departing from the spirit or central attributes thereof. Because the foregoing description of the present invention discloses only a particularly preferred exemplary embodiment of the invention, it is to be understood that other variations are recognized as being within the scope of the present invention. For example, those ordinarily skilled in the pertinent arts will recognize that the method diagrammatically illustrated and described with reference to FIGS. 7 and 8 is a form of lapping. Thus, it is apparent that this and other forms of lapping and abrasive planarizing may be used to practice the method of this invention. Accordingly, the present invention is not limited to the particular embodiment which has been described in detail herein. Rather, reference should be made to the appended claims which define the spirit and scope of the present invention.

What is claimed is:

1. A method of manufacturing an orifice plate for an inkjet printhead having a substrate and a thin-film structure carried on said substrate, the thin-film structure including energy-dissipating elements for providing energy for ejecting printing fluid from said printhead during a printing event, and the thin-film structure defining a surface disposed away from said substrate, wherein the orifice plate manufacturing method includes:

originally forming the orifice integral with other orifice plates connected along their perimeters in a single layer array to form an intermediate workpiece, each orifice plate including a plurality of upstanding spaced apart peripheral rib members for attachment to said thin-film structure, and further including a plurality of wall portions having upstanding barriers which define multiple chambers for receiving printing fluid, said wall portions of said orifice plate also defining a plurality of orifices respectively separated by said upstanding barriers;

creating mutually coplanarized end edges on said upstanding barriers by contact with an abrasive member wherein said end edges present an abrasively truncated smooth surface for engagement contact with said thin-film structure; and separating an individual orifice plate from the single layer array of said intermediate workpiece for attachment to said thin-film structure.

2. The method of claim 1 wherein manufacturing said orifice plate includes moving the abrasive member relative said workpeice in a predetermined planar direction.

3. The method of claim 1 wherein manufacturing said orifice plate includes applying force substantially evenly across the abrasive member and at a predetermined elevation to create said mutually coplanarized end edges.

4. The method of claim 1 wherein said workpiece includes perforations separating adjacent orifice plates in the single array on the workpiece, and said separating includes separating individual orifice plates along the perforations.

5. The method of claim 1 wherein manufacturing said orifice includes creating elongated barrier walls.

6. The method of claim 1 wherein manufacturing said orifice plate includes creating a plurality of elongated barrier walls which are substantially parallel.

* * * * *

UNITED STATES PATENT AND TRADEMARK OFFICE

CERTIFICATE OF CORRECTION

PATENT NO. : 6,732,433 B2
DATED : May 11, 2004
INVENTOR(S) : Roger Robert Sleger It is certified that error appears in the above-identified patent and that said Letters Patent is hereby corrected as shown below:

Column 8,
Line 35, delete “workpeice” and insert in lieu thereof -- workpiece --.

Signed and Sealed this

Twenty-seventh Day of July, 2004

JON W. DUDAS
*Acting Director of the United States Patent and Trademark Office*